United States Patent [19]

Fletcher et al.

[11] Patent Number: 4,518,418

[45] Date of Patent: May 21, 1985

[54] ELECTRON BEAM REFINEMENT OF METALS, PARTICULARLY COPPER

[75] Inventors: Archibald W. Fletcher, Tucson, Ariz.; Charles d'A. Hunt, Occidental, Calif.

[73] Assignee: Duval Corporation, Houston, Tex.

[21] Appl. No.: 503,376

[22] Filed: Jun. 10, 1983

[51] Int. Cl.[3] ..... C22B 4/00

[52] U.S. Cl. ..... 75/10 R; 75/65 EB

[58] Field of Search ..... 75/65 EB, 10 R

[56] References Cited

U.S. PATENT DOCUMENTS

| | | | |
|---|---|---|---|
| 1,840,946 | 1/1932 | Hall | 266/200 |
| 2,174,559 | 10/1939 | Anderson et al. | 266/19 |
| 2,698,297 | 12/1954 | Bowden et al. | 202/158 |
| 2,823,111 | 2/1958 | Davey et al. | 75/88 |
| 2,939,783 | 6/1960 | Lundevall | 75/88 |
| 3,005,859 | 10/1961 | Candidus | 13/31 |
| 3,151,042 | 9/1964 | Koshoot | 202/40 |
| 3,183,077 | 5/1965 | Kraus | 75/10 R |
| 3,210,454 | 10/1965 | Morley | 13/1 |
| 3,219,435 | 11/1965 | Grueber et al. | 75/10 R |
| 3,234,606 | 2/1966 | Smith, Jr. | 75/73 |
| 3,235,647 | 2/1966 | Hanks | 13/31 |
| 3,288,594 | 11/1966 | Smith, Jr. | 164/50 |
| 3,342,250 | 9/1967 | Trepschuh et al. | 164/50 |
| 3,343,828 | 9/1967 | Hunt | 266/34 |
| 3,409,729 | 11/1968 | Hanks et al. | 13/31 |
| 3,450,824 | 6/1969 | Hanks et al. | 13/31 |
| 3,484,233 | 12/1969 | Bonilla | 75/63 |
| 3,494,804 | 2/1970 | Hanks et al. | 148/1.6 |
| 3,496,159 | 2/1970 | Spence | 260/97.6 |
| 3,607,222 | 9/1971 | Kennedy | 75/65 |
| 3,632,334 | 1/1972 | Quintin | 75/63 |
| 3,778,044 | 12/1973 | Brown et al. | 75/88 |
| 3,785,944 | 1/1974 | Atwood et al. | 204/107 |
| 3,879,272 | 4/1975 | Atwood et al. | 204/107 |
| 3,948,495 | 4/1976 | Semenovich et al. | 266/16 |
| 4,035,574 | 7/1977 | Kennedy | 75/65 EB |
| 4,043,802 | 8/1977 | Esdaile et al. | 75/63 |
| 4,190,404 | 2/1980 | Drs | 75/65 EB |
| 4,265,644 | 5/1981 | Gammon | 266/150 |

OTHER PUBLICATIONS

L. K. Bigelow and I. S. Servi, "Quality of Cathode Copper", AIME Annual Meeting, New York, Feb. 19, 1975.

Gilchrist, *Extraction Metallurgy*, 2nd Edition, Pergamon Press (1980), p. 132.

Olette, "Vacuum Distillation of Minor Elements from Liquid Ferrous Alloys", *Physical Chemistry of Process Metallurgy*, part 2', G. R. St. Pierre, Ed., Interscience, New York (1961), pp. 1065–1087.

Santala et al., *The Journal of Vacuum Science and Technology*, vol. 7, No. 6, (1970), p. 22.

Hunt et al., "Metal Refining in High Vacuum by Distillation of Electron Beam Hearths", Southwest Minerals Conference, San Francisco, Mar. 25–28, 1979, Abstract.

Hunt et al., "Proposed Program for Sales of a Copper-Silver Separation Process Based upon Volativity Differences", Southwest Mineral Conference, San Francisco, Mar. 25–28, 1979, Handout.

Schiller et al., "Deposition by Electron Beam Evaporation with Rates of up to 50 μm/s", 3rd Conference on Metallurgical Coatings, Apr. 3–7, 1978, San Francisco, Calif.

Schiller et al., *Thin Solid Films*, vol. 54 (1978) 1.S, pp. 9–21.

*Primary Examiner*—Peter D. Rosenberg

*Attorney, Agent, or Firm*—Millen & White

[57] ABSTRACT

It has been discovered that suprisingly effective removal of impurities from copper can be achieved using electron beam distillation, especially with respect to relatively low amounts of impurities such as Ag, Se, Te, S, Bi and Pb. Certain pretreatments of unrefined metal prior to electron beam irradiation significantly improve overall results. These include iron and/or oxygen removal treatments. In a particularly advantageous embodiment, these impurity removal treatments and combinations thereof are achieved in conjunction with a new method of electron beam distillation of metals which involves a horizontal multistage system with recycle of the condensed vapor phases.

31 Claims, 4 Drawing Figures

CORRELATION BETWEEN Fe & O2
1800
1600
1400
1200
1000
800
600
400
200
PPM O2
10
20
30
40
50
60
PPM Fe

SCHEMATIC DIAGRAM AND FLOW SHEET

ELECTRON BEAM REFINEMENT OF METALS, PARTICULARLY COPPER

CROSS REFERENCE TO RELATED APPLICATION

This application is related to co-pending application Ser. No. 503,377 filed on even date.

BACKGROUND OF THE INVENTION

In conventional practice, refined copper is produced from sulfide concentrates by pyrometallurgical operations leading to the production of blister copper which is electrolytically refined. The various impurities associated with copper in the concentrate are removed during these operations which could typically include smelting in reverberatory, electrical or flash furnaces followed by oxidation of the resulting matte by conversion and then anode furnace refining prior to casting anodes for electrolytic refining.

About 15 percent of the copper produced annually is derived from oxide ores. In such cases it is possible to use a hydrometallurgical process involving acid leaching in agitated tanks, vats or dumps followed by solvent or liquid-liquid extraction. The latter provides a pure concentrated solution of copper sulfate from which the pure metal is won by electrodeposition onto cathodes in electrolytic cells having insoluble anodes. This technology is well described in *Extractive Metallurgy of Copper,* A. K. Biswas and W. G. Davenport, Pergammon Press, New York, 1980, whose disclosure is incorporated by reference herein.

In the past 20 years, there has been a marked increase in the demand by wire mills for the copper produced annually in the USA and this application is the most demanding in terms of cathode quality. In order to be reduced to wire, the cathode has to be melted before casting and hot rolling and during these operations careful control must be exercised to ensure that the original quality of the cathode is not impaired. For the melting operation, shaft furnaces are generally superior to other types in minimizing impurity levels, and continuous rod drawing systems have now almost entirely replaced wire bar static casting followed by batch hot rolling.

Acceptable grades of copper for magnet wire drawing have to conform to rigid chemical specifications and to standards for physical properties such as conductivity, mechanical integrity and annealability set by wire manufacturers. The finer the gauge of the wire the more stringent these specifications become and failure to meet these specifications results in loss of production by frequent breakage. These requirements have been described in "Quality of Cathode Copper," L. K. Bigelow and I. S. Servi, AIME Annual Meeting, New York, Feb. 19, 1975, whose disclosure is incorporated by reference herein. Especially important is to provide very low levels of S, Pb, Sb, As, Se, Te, Bi and Ag, on the order of a few ppm of each.

In recent years there has been considerable interest in the development of hydrometallurgical processes for treating sulfide concentrates in order to overcome difficulties and high costs in meeting stringent environmental standards set for pyrometallurgical smelters. A wide range of such processes has been seriously considered in recent years as discussed in "Exploitation of Complex Sulfide Deposits: A review of processing options from ore to metals," G. Barbery, A. W. Fletcher and L. L. Sirois, *Complex Sulfide Ores,* Institute of Mining and Metallurgy, London, 1980, whose disclosure is incorporated by reference herein. This article describes three sulfate based processes and eight chloride based processes which have been tested on a laboratory or pilot plant scale. Yet another seven processes are described in the study carried out by Charles H. Pitt and Milton E. Wadsworth for the U.S. Department of Energy, Division of Industrial Energy Conservation, (Contract No. EM-78-S-07-1743) and published in "An Assessment of Energy Requirements in Proven and New Copper Processes," University of Utah, December 1980, whose disclosure is incorporated by reference herein. It must be emphasized that in these eighteen different processing routes, the final copper metal product is obtained after a series of unit operations which differ in the basic chemistry employed. It will not be surprising therefore to find that the trace impurities in the final product will differ from case to case and certainly from conventional smelting and refining practice.

There is a need therefore for an alternative refining process which will efficiently and economically refine the new copper products from these developing hydrometallurgical operations as well as other processes. This will be particularly important for processing routes which do not include an electrolytic refining step which, among other examples, separates copper from silver. Such processes include the CLEAR, Cymet, Elkem, Dextec, Envirotech Corporation and the University of Utah Martin-Marietta processes. See, Barbery et al and particularly with respect to CLEAR, G. E. Atwood and R. W. Livingston, "The CLEAR Process, A Duval Corporation Development," Erzmetall 33 (1980) No. 5 and U.S. Pat. Nos. 3,785,944 and 3,879,272, whose disclosures are incorporated by reference herein.

One potential method of achieving the necessary refinement of copper, and of other metals as well, involves distillation, especially by electron beam irradiation. The technique of separating the components of a mixture of metals by the selective distillation of those having lower boiling points and higher vapor pressures at the operating temperature, dates back to 1913 when the celebrated Langmuir equation was published relating the rate of evaporation of an element or pure substance into a vacuum to the evaporation temperature. The rate is shown to be proportional to the activity coefficient of the element being evaporated. This is simply a recognition of the likelihood of deviations from ideality in any given system. Thus, Raoult's Law predicts that, ideally, the vapor pressure of a given species in a mixture will be given by the product of the mole fraction of that species and its vapor pressure in the pure state. The activity of the species, on the other hand, is given by the ratio of the actual vapor pressure of the species to the vapor pressure of the species in the pure state, all parameters, of course, being taken at the same temperature. Hence, the activity of a given element in the system of interest provides a measure of the deviation from ideality at a given temperature.

In practice, ideal behavior has been observed in some systems; however, in most systems, negative or positive deviations are observed. For example, in the bismuth/tin system, the elements follow Raoult's Law—ideal behavior is observed. In the lead/zinc system, positive deviations from ideality are observed, i.e., activities greater than 1 have been measured, usually due to miscibility gaps. In the magnesium/bismuth and zinc/copper systems, negative deviations from ideality have been observed, usually due to the formation of relatively nonvolatile compounds, i.e., the effects of intermetallic interactions serve to provide an energy barrier to the expected evaporation of the more volatile species.

As can be seen, a priori, it is not possible to predict whether a given metallic species can be removed from a bulk metal based simply on a comparison of the relative volatilities of the two metals in the pure state. When removal of relatively small amounts, e.g., traces of impurities from a bulk metal is of concern, the situation is significantly exacerbated and more unpredictable. For example, as discussed by Bigelow et al, supra, page 13, "the specific effect of a trace element is most powerful when the first small amount is added; thereafter, the effect continuously decreases until the solubility limit is reached." In evaporating an impurity from a bulk metal, as the concentration of the impurity continuously decreases, the average degree to which the remaining impurity atoms are bound by bulk metal atoms must be expected to significantly increase at least at some stage. Hence, in binary metallic systems, distillability is a variable and unpredictable process as a function of concentration. Moreover, the successful distillation of an impurity from a metal at relatively high contents of that impurity is not a sufficient basis for reliably predicting that the impurity will still be distillable from the metal at lower concentrations.

The situation becomes extremely complex when more than one impurity is involved, i.e., in ternary or higher systems. As also recognized by Bigelow, supra, page 13, "various trace elements may interact with each other, for instance, silver with selenium and lead with sulfur," with particular reference to the presence of these metals in copper. Furthermore, unlike the binary system where the first small amount causes, proportionately, the greatest effect, when considering interactions between and among impurities per se, the opposite effect is to be expected. That is, in binary systems, the first impurity atom encounters only the effects of bulk metal atoms. Subsequent impurity atoms see an increasingly diluted effect of the bulk metal atom and dimer interactions can be ignored at least intially. In ternary and higher systems, as the amounts of the two or more impurities are increased upward from the first such atoms, the probability of effective intermetallic interactions between the impurities increases since the average distance between impurity atoms correspondingly decreases with increasing concentration. Thus, impurity atoms are more tightly "bound" by each other the higher the concentration of either, at least up to some unpredictable point at which the effect of a given concentration of impurity atoms on other impurity atoms might become saturated. As a result, despite the fact that a given impurity may have been successfully distilled from a base metal in the presence of a given impurity distribution in the metal, it is not possible to predict that the same impurity will be distillable from the same metal if the impurity distribution is changed since the spectrum of intermetallic interactions will change or, at least, a change must be expected.

As can be seen, there are many possible interactions in a given system which can lead to deviations from ideality. This makes the distillability of a given impurity from a base element having a given distribution of impurities unpredictable. The probability and severity of intermetallic interactions (e.g., compound formation) between impurities and the bulk metal generally decreases with increasing impurity concentrations. The probability and severity of intermetallic interactions between and among impurities, in contrast, will generally increase with increasing impurity concentration. In both cases, the greatest change in the level of intermetallic interactions will normally occur as a function of changes in impurity concentrations at low levels, e.g., trace elements on the order of 1-100 ppm or less. Hence, when considering a single impurity in a bulk metal, it may be possible to predict that higher concentrations of the impurity will be distillable if it has been observed that lower concentrations have been distillable, but the reverse will not be true. When considering bulk metals containing more than one impurity, the distillability of one impurity at a given concentration and in the presence of given concentrations of other impurities, will not provide a basis for predicting the distillability of the same impurity from the same bulk metal if its concentration is higher (increased impurity interactions) or lower (increased bulk metal interactions) or if the concentration of the other impurities is higher (increased impurity interactions) or lower (increased bulk metal interactions).

The complexity involved in predicting whether a given impurity will be distillable from a given metallic system has been well summarized by Gilchrist, *Extraction Metallurgy,* 2nd Edition, Pergamon Press (1980), page 132, > The treatment of activities in multicomponent systems is more difficult than in binary systems because interactions between atoms of different solutes usually alter their activities from the values they would have had in binary solutions at the same concentrations. In a few cases activities have been determined by experiment over large parts of ternary systems, but in general this approach is inadequate to meet the degree of complexity likely to be encountered in industrial applications;

and by Olette, "Vacuum Distillation of Minor Elements from Liquid Ferrous Alloys," *Physical Chemistry of Process Metallurgy Part 2'*, pages 1065–1087, G. R. St. Pierre, Ed., Interscience, New York, 1961, at 1070.

> When calculating vapor pressures of the elements above their solutions in iron, it is important to consider these deviations from Raoult's Law for the effect can be very large, especially in complex alloys.

In short, where the relative concentrations of impurities in a given bulk metal system are different from those for which data are available, it is not possible to predict the distillability of a given impurity element in the new system.

The copper system provides an excellent example of the complexity encountered in metal systems of interest in industry. Hydrometallurgically processed copper typically contains impurities including selenium, tellurium bismuth, lead, sulfur, silver, antimony, arsenic, zinc, iron, tin, nickel, oxygen, inter alia. The levels of these impurities can vary significantly from process to process and from ore sample to ore sample. Most of these elements have been shown to form intermetallic compounds with copper in at least some temperature range. In addition, there are very many intermetallic compounds observed and/or predicted between impurity species, inter alia, $Ag_3Sb$, $Sb_2Te_3$, $As_2Te_3$, AsTe, $Sb_2Se_3$, $As_2Se_3$, AsSe, PbTe, PbSe, $Ag_{18}Te_{11}$, $Ag_2Te$, $Ag_2Se$, SeO, SeS, TeO, TeS, BiO, BiS, SbO, SbS, AsO, AsS, etc. See, e.g., Nagamori et al, Metallurgical Transactions B, Volume 13B, September 1982, 319 and the F*A*C*T SYSTEM program by W. T. Thomspon, A. D. Pelton, C. W. Bale, FACT SYSTEM, Montreal, Quebec, Canada, Copyright 1982, Thermfact LTD/LTEE. While many of these intermetallic compounds are predicted only in theory, many others have been observed. The high complexity of the impurity distribution in copper metal, especially those which have been hydrometallurgically processed, is indisputable.

Heretofore, no sufficiently effective distillations of hydrometallurgically processed copper have been reported. All distillations using conventional methods such as induction heating fail to provide the necessary low impurity levels. However, Santala et al have reported an electron beam laboratory distillation of silver from copper in otherwise highly pure binary alloys (The Journal of Vacuum Science and Technology, Vol. 7, No. 6, 1970, 22). Therein is reported the distillation of silver from copper/silver alloys containing respectively, 8%, 15.7%, 29.9% and 42.2% of silver. In all cases, relatively high amounts of silver remained in the refined alloy. The lowest retained amount of silver was 900 ppm in the experiments using the alloy containing 8% silver. The materials used to prepare the alloys were commercial purity fine silver containing 1–10 ppm of copper; less than 1 ppm of iron; less than 1 ppm of Mg; 1–10 ppm of Pb; and less than 1 ppm of Si. The starting material copper was certified OFHC (oxygen free high conductivity) copper meeting the specifications of ASTM B-170-66T which provides the following maximum impurity levels: 1 ppm of Cd; 3 ppm of P; 18 ppm of S; 1 ppm of Zn; 1 ppm of Hg; 10 ppm of Pb; 10 ppm of Se; 10 ppm of Te; 10 ppm of Bi; less than 40 ppm in total of Se, Te, Bi, As, Sb, Sn and Mn; and 10 ppm of $O_2$.

Hence, Santala et al provide evidence that silver can be distilled from copper in the relatively high silver concentration range of 900 ppm and above, even in the presence of the mentioned impurity spectrum permitted in OFHC copper. But in accordance with the foregoing, it is clear that such an experiment does not resolve a consideration of whether amounts of silver greater than 20 ppm can be distilled from hydrometallurgical copper to provide final silver concentrations of less than 20 ppm, which is a typical spec for the wire mill industry. The complexity of potential intermetallic effects in the concentration range from 900 ppm of silver to less than 20 ppm of silver precludes any expectation that silver can be distilled to the requisite low levels using the electron beam method as employed by Santala et al or any other method.

In unreported electron beam distillation experiments performed by one of the inventors of this application in the sixties and which are believed not to be effective prior art vis a vis this application, silver was distilled from a starting material copper metal containing approximately 10 ppm of silver and a total of about 20 ppm of Bi, Pb, Se, Te, and S. See "Metal Refining in High Vacuum by Distillation of Electron Beam Hearths," Hunt et al, Pacific Southwest Minerals Conference, San Francisco, Mar. 25–28, 1979, Abstract; and "Proposed Program for Sales of a Copper-Silver Separation Process Based upon Volativity [sic] Differences," handout at same conference, which briefly mention these experiments. Once again, these experiments do not resolve the problem of the distillability of silver at starting concentrations greater than 20 ppm. The increased potential for additional intermetallic interactions at the higher silver concentrations in combination with even the same impurity distribution is an additional complex factor precluding any predictability or expectation of successful distillation.

Accordingly, no experiments performed heretofore resolve or reliably predict an answer to the question of the distillability of the impurity spectrum present in industrially available unrefined copper metal including lead, selenium, tellurium, bismuth, sulfur, etc. and especially including the ever-present silver at least because the silver levels involved are greater than about 20 ppm, yet must be lowered to levels less than 20 ppm.

From the foregoing, it will be seen that electron beam treatments of metals including distillation of impurities from metals have been contemplated in the past. In this regard, see, e.g., U.S. Pat. Nos. 4,035,574; 3,607,222; 3,494,804; 3,342,250; 3,219,435; 3,210,454; 3,183,077; and 3,005,859; all of whose disclosures are incorporated by reference herein. Although a wide variety of arrangements have been utilized in normal heating techniques, including vertical column fractional distillations with reflux (see, e.g., U.S. Pat. Nos. 4,265,644; 4,043,802; 3,948,495; 3,778,044; 3,632,334; 3,484,233; and 2,823,111), the advantages of conventional fractional distillation, so familiar in conjunction with liquids such as hydrocarbons, have never been achieved in electron beam systems. To a large degree, this is due to the unique and stringent requirements of electron beam operation.

In addition, the normal vertical alignment of distillation stages is not very compatible with electron beam systems; rather, horizontal arrangement of the different stages is more practical. While horizontally arranged multistage processes have been suggested in the past (See, e.g., U.S. Pat. Nos. 2,174,559 and 1,840,946 regarding metals and U.S. Pat. Nos. 3,496,159; 2,698,287; and 3,151,042 regarding conventional liquids), even in electron beam evaporation operations (see, e.g., U.S. Pat. Nos 3,343,828 and 3,288,594 whose disclosures are incorporated by reference herein), there has never been a suggestion of how to achieve the advantageous plate-like effects of conventional fractional distillations in electron beam systems. In essence this is because the conventional technology used to achieve a reflux in normal liquid or even in melted metal systems, even in horizontal arrangements, is simply not applicable to electron beam systems because of the dramatically different requirements involved.

For example, reflux with countercurrent contact of vapor and liquid which gives the reboiling phenomenon in conventional vertical fractional distillations, is not possible in electron beam distillations. The vacuum requirements are simply too stringent as are the requirements for minimal beam/vapor interactions. Furthermore, a horizontal distillation with recycle such as that of U.S. Pat. No. 2,939,783 is also not applicable to an electron beam operation since the vapor phase itself is recycled. It has been discovered that a recycle of this nature in a multistage electron beam distillation is very unsatisfactory.

SUMMARY OF THE INVENTION

Accordingly, it is an object of this invention to provide a method for distilling impurities by electron beam irradiation from industrially available copper metal e.g., copper metal including a total amount of Bi, Se, Te, Pb and S which is greater than about 35 ppm, wherein the impurity distribution includes amounts of silver greater than 20 ppm and wherein the residual amount of silver is less than 20 ppm and wherein there is a significant reduction in the residual content of the other impurities also.

It is another object of this invention to provide a method of refining metals by electron beam irradiation wherein the metal initially contains a non-volatile impurity which has a higher affinity for oxygen than the base metal and effective removal of the impurity is accomplished prior to the electron beam irradiation step.

It is a further object of this invention to provide a method of refining a metal by electron beam irradiation wherein the metal contains an amount of oxygen greater than 200 ppm and an effective removal of oxygen is accomplished prior to the electron beam irradiation step.

It is yet another object of this invention to provide a horizontal multistage electron beam distillation method wherein the effects of conventional fractional distillation are achieved.

Upon further study of the specification and appended claims, further objects and advantages of this invention will become apparent to those skilled in the art.

These objects have been achieved, in one aspect, by providing a method of refining copper metal which contains at least 35 ppm in total of selenium, tellurium, sulfur, bismuth and lead and at least 20 ppm of silver, which impurities are capable of forming intermetallic species with copper atoms, with each other or with other impurities in the copper metal, comprising irradiating the copper metal with an electron beam of sufficient strength and duration to heat the metal and volatilize a portion thereof, whereby, in the remaining copper metal, the total content of selenium, tellurium, sulfur, bismuth and lead is reduced to less than about 20 ppm and the silver content is reduced to less than about 16 ppm.

In another aspect, these objects have been achieved by providing in a method of refining a metal by volatilization of a portion thereof by electron beam irradiation, the improvement wherein the metal contains a non-volatile impurity, e.g., iron, which has a higher affinity for oxygen than said metal, and the method further comprises, prior to treating the metal with the electron beam for refinement, melting the metal under conditions whereby its oxygen content is adjusted to a value greater than about 300 ppm, maintaining the melt for a time sufficient for the formation of an oxide of iron or other impurity, and separating the oxide of said impurity from the melted metal.

In another aspect, these objects have been achieved by providing, in accordance with this invention, in a method of refining a metal by electron beam irradiation, the improvement wherein when the metal has an oxygen content greater than 200 ppm, the method further comprises, prior to treating the metal with the electron beam for refinement, melting the metal under conditions whereby its oxygen content is lowered to a value of less than 200 ppm.

In still another aspect, these objects have been achieved in accordance with this invention by providing a multistage method of refining a metal containing at least two metallic components in at least two sequential metal vaporization stages substantially horizontally arranged and each having a metal feed thereto, comprising, in each stage, irradiating the metal feed with an electron beam effective to heat the metal to a temperature at which the total vapor pressure of the melt is about 0.5 to 7 torr, and at which the partial vapor pressure of at least one metal component of the melt is different from that of at least one other metal component of the melt, and forming a vapor phase and a melt phase, in which each phase is either enriched or depleted in at least one metal component;

wherein the vapor pressure of the condensate of said vapor phase at its condensation point is less than about $10^{-3}$ torr;

and wherein the effective operating pressure of each stage is maintained at a low level compatible with electron beam irradiation;

passing the melt phase of each stage downstream to form at least part of the feed of the next stage; and recycling the vapor phase of at least one stage upstream to at least one preceding stage to form at least part of the feed thereto;

wherein all vapor phases passing between stages are condensed in the originating stage to form a corresponding liquid phase which is fed to the receiving stage via transport means wherein said phase remains liquid throughout its passage in and between stages.

In various other aspects, these objects have been achieved by providing combinations of all of the mentioned methods as well as various preferred aspects of the individual methods and combinations thereof.

BRIEF DESCRIPTION OF THE DRAWINGS

Various other objects, features and attendant advantages of the present invention will be more fully appreciated as the same becomes better understood when considered in conjunction with the accompanying drawings, and wherein.

DETAILED DISCUSSION

Figure 1:
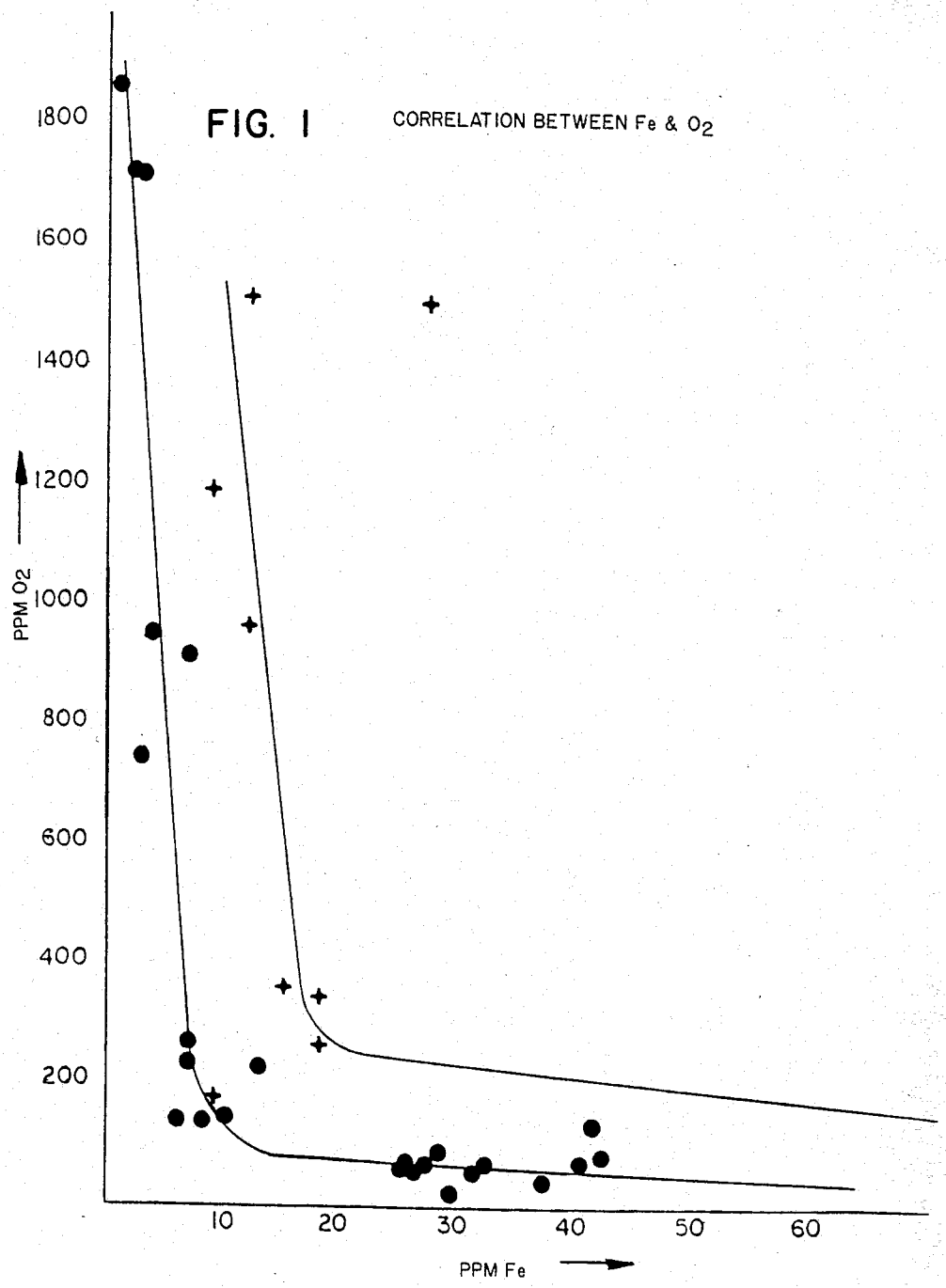
FIG. 1 shows the relationship between iron and oxygen contents in 400 lb. copper melts using either (+) a gas fired furnace and a silicon-carbide crucible or (•) an induction furnace and a fire clay-graphite crucible, in all cases the oxygen content of the melts being reduced by graphite addition.

A primary aspect of this invention is based on the discovery that, using electron beam heating, a significant removal of impurities including bismuth, selenium, tellurium, lead, sulfur and silver, inter alia, can be effected in copper metal even when relatively high amounts of such impurities are initially present. For example, initial amounts of about 35 ppm or more of the total of Bi, Se, Te, Pb, and S and at least 20 ppm of Ag can be reduced to 20 ppm or less and 16 ppm or less, respectively.

Accordingly, this invention in its broadest aspects pertains to the discovery that any single one of the mentioned impurities can be distilled from industrially available, generally unrefined copper metal, despite the higher probability of intermetallic interactions or a decrease in impurity activity caused by an increased impurity content of at least one impurity vis a vis the amount present in the copper metal distilled in prior art experiments. As a result, it will be seen by those skilled in the art that the foregoing definitions of the copper refining method of this invention constitute a convenient means of describing the surprising discovery on which this invention is based. Hence, the reduced level of total Bi, Se, Te, Pb and S content of 16 ppm or of Ag of 20 ppm is not meant to be a precise limitation. Any reduction in the content of any one of these metals by electron beam irradiation under the described initial conditions constitutes an equivalent method.

Often, the copper metal to be refined will contain significantly higher amounts of the mentioned impurities. For example, typical silver contents in hydrometallurgically processed copper will be 200, 300, 400, or more ppm. Sulfur contents are also often much higher, e.g., 100, 200, etc. or more ppm. Relatively high lead contents are also observed, e.g., greater than 10, e.g., 20, 40, 60, etc. ppm. Typically, selenium, tellurium and bismuth contents are somewhat lower, e.g., 1, 3, 5, etc. ppm of selenium, 1, 3, 5, etc., ppm of tellurium, and 2, 5, 8, etc. ppm of bismuth but occasionally much higher, even on the order of 1000 ppm of Bi. As can be seen, various combinations of such impurities, greater than the mentioned 35 ppm in total, will often be present.

Other typical impurities present in the copper metal will include 1–10 ppm or more of each of antimony and arsenic, 1–20 ppm of tin, 1–20 ppm of nickel, 1–50 ppm of zinc, 1–50 ppm of iron, 1–200 ppm of oxygen (assuming a pretreatment as described below), as well as many others depending upon the particular copper metal of interest.

Further in accordance with this invention, it has been discovered that essentially all of the impurities which are more volatile than copper, in practice, will be volatilized by the electron beam distillation method of this invention. For those impurities which are less volatile than copper, a refinement can still be effected by electron beam irradiation by recovery of the copper metal as a condensate rather than as the remaining undistilled melt. In particular, the multistage recycling method described below can be used in this manner.

This invention is particularly applicable to copper metal which has been processed hydrometallurgically. See, e.g., the Biswas et al, Barbery et al and Pitt et al references discussed above. Exemplary processes include the CLEAR, Cymet, Elchem, Dextec, Envirotech Corporation and University of Utah Martin-Marietta processes described therein. CLEAR copper is an especially preferred starting material. See the Atwood et al reference mentioned above, as well as U.S. Pat. Nos. 3,785,944 and 3,879,272.

The refined copper obtained by the electron beam irradiation of this invention will have reduced amounts of all impurities which must be removed from copper in order to provide sufficient quality for wire mill applications. In fact, for many impurity elements, the methods of this invention provide lower concentrations than heretofore achievable despite the simplicity and low cost involved. Thus, the final amount of silver can readily be lowered to less than 20, 5, 1 ppm or even lower when desired. These numerical final values also apply to all of the other important impurities such as bismuth, selenium, tellurium, lead, sulfur etc. Amounts less than 1 ppm are even more readily achieved for the volatile impurities such as selenium, tellurium, bismuth and lead than for silver. Thus, in all cases, the proposed stringent industry specifications for wire mill copper will readily be met including the ASTM and LME values mentioned below as well as the values suggested by Bigelow et al in the reference mentioned above, i.e., 10–20 ppm of sulfur; 2–6 ppm of lead; 1–4 ppm of selenium; 1–2 ppm of tellurium; and 0.5–2 ppm of bismuth. Furthermore, when copper is recovered as a distillate, the proposed specifications for the less volatile impurities such as antimony (e.g., 2–5 ppm) and arsenic (1–4 ppm) can also be achieved.

Also included within the scope of this invention is the possibility of recovering the impurity-containing distillate when the amount of a given impurity, most notably silver, in the corresponding condensate or solid is sufficiently high to make this economically or otherwise desirable.

Suitable and preferred conditions of operation for the electron beam irradiation distillation of this invention can be routinely determined, perhaps with a few preliminary experiments. Generally, it will be desired to achieve a melt temperature as high as possible consistent with the maintenance of a vapor pressure difference between at least two metal components of the melt which are to be separated, and consistent with the requirements of effective electron beam irradiation. For example, the temperature cannot be so high that the corresponding volatilization rate is so rapid that splashing occurs creating a detrimental interaction between the escaping vapor and the electron beam. Of course, in terms of operating parameters, melt temperature will primarily be determined by beam power and the degree of purification for a given system will be adjustable by total duration of beam irradiation.

As an illustration of the unpredictable but routinely determinable variations which must be taken into account to determine an appropriate combination of melt temperature and electron beam irradiation time, variations in the volatilization ratio for the copper/silver system can be considered. This ratio can be defined as follows for dilute solutions, e.g., of about 1% or less in an impurity:

$$\frac{\dfrac{[\text{impurity}]_g}{[\text{metal}]_g}}{\dfrac{[\text{impurity}]_l}{[\text{metal}]_l}}$$

wherein $[\text{impurity}]_g$ represents the concentration of the impurity species in the gas phase, $[\text{metal}]_g$ represents the concentration of the primary metal constituent in the gas phase and the subscript "1" refers to the corresponding quantities in the liquid phase.

Such ratios will vary primarily with temperature.

In the copper metal/silver impurity system, it has been determined that the volatilization ratio for removal of silver from copper, at a silver concentration of 50–100 ppm, is in the range of approximately 40–60 at a melt temperature of about 1200°–1350° C.; at the higher temperature range of 1600°–1650° C., the ratio decreases to values of approximately 20–30.

As can be seen, the inherent ability to remove silver from copper decreases as temperature is increased, but, of course, the volatilization rate increases. Hence, a balance must be achieved between the beneficial effects of temperature on increased rate of vaporization and the detrimental effects of decreased volatilization ratio between silver and copper. Nevertheless, using a few routine preliminary characterization experiments, combinations of very satisfactory irradiation times and melt temperatures have been determined for the copper/silver system. Similar determinations can be made for any other system employed in conjunction with any aspect of this invention.

In its broadest aspects, the invention is operable at temperatures which are only slightly higher than the melting point of the copper metal itself which is about 1083° C., e.g., at temperatures of 1200°-1250° C. However, in view of the volatilization ratios and rates which are involved, a preferred range is 1350°-1800° C., most preferably 1600°-1650° C. In order to achieve a lowering of silver content from approximately 250 ppm to less than 20 ppm, the irradiation time at a temperature of 1200°-1350° C. is about 5-10 minutes; to achieve the same purification at a temperature of 1600°-1650° C., typical irradiation times are in the 2-5 minute range, e.g., 4-5 minutes at about 1600° C. As can be seen, the effect of the higher vaporization rate predominates in the selection of melt temperature due primarily to considerations of efficiency.

Normally, the electron beam power will also be adjusted to achieve a vaporization rate corresponding to a vapor pressure at the melt surface of about 0.5-7 torr. At lower vaporization rates, the efficiency of the distillation is unacceptably low for most applications even with relatively large hearths; at higher rates, the amount of vapor entering the vacuum furnace is unacceptably high and/or the melt becomes turbulent. Before these effects are reached, however, it is preferred to operate at the higher rates since this maximizes beam power utilization. Usually the vapor pressure at the melt surface is in the range of 1-5 torr.

Other details of the electron beam irradiation are fully conventional. For thorough discussions of the selection of beam parameters and propagation configurations, scanning modes, gun types, crucible dimensions, etc. see, e.g., the electron beam related references cited above and as well U.S. Pat. Nos. 3,450,824; 3,409,729, 3,235,647; and 3,234,606, and especially *Electron Beam Technology,* S. Schiller et al, John Wiley and Sons (1982), all of whose disclosures are incorporated by reference herein.

For example, beam diameters are nominally about 2-3 inches. Beam shapes are not critical and can be circular elliptical, etc. Usually, the beam will scan the surface of a metal in any of a large number of appropriate patterns, typically achieving a dwell time at a given point of about a few milliseconds, the precise rate being determined in conjunction with the beam power and the requirements discussed above, e.g., melt temperatures, vaporization rates, etc. In a preferred mode, the beam will be scanned in a pattern which effectively mixes the melt thereby optimizing access of all impurity species to the surface from which they can vaporize. Continuous mode or pulse mode beams can be used.

Electron beam guns are commercially available and many are satisfactory for the purposes of this invention. Furnace pressures will generally be $10^{-3}$ torr or lower, preferably in the range of $10^{-4}-10^{-5}$ torr or lower. The lower values are especially preferred when a swept beam is utilized. Such beam scanning significantly increases the probability of interaction between the electron beam and any gaseous species present in the chamber since the net volume meeting the beam is higher. For the reasons fully discussed below, such interactions must be minimized.

The hearth is fully conventional and will be compatible with the melt at the temperatures employed. It is a major advantage of electron beam distillation that very large ratios of surface area to volume can be achieved. In essence, the beam interacts only with the surface of the melt, thereby avoiding the need for any appreciable working depth. For copper, the crucible will usually be graphite but other refractory crucibles can be used. Typical crucible depths will be in the range of 0.25-2 inches, most preferably 0.5-0.75 inch. Particularly preferred modes of operation are as described in Schiller et al supra.

In electron beam distillations of metals such as copper, a relatively large amount of vapor will be produced. In such systems, it is necessary to minimize the interaction between the electron beam and the vapor rising from the surface. Such interactions cause the evolution of secondary electrons from the gaseous species which in turn, cause the formation of a space charge in the beam path which deflects the beam, thereby causing a significant loss in beam power. This effect results in a plateau in the achievable vaporization rate, i.e., often even significant increases in beam power will not increase the vaporization rate, thereby significantly decreasing the efficiency of operation. Hence, it is important to minimize all sources of interaction of the electron beam with gaseous species. See, e.g., U.S. Pat. No. 3,450,824.

Typically, the instantaneous region of interaction between the rising vapor and the electron beam should be about 12 inches or less in maximum dimension. One way to achieve a minimization of vapor/beam interaction is to employ an electron beam magnetic deflection system, e.g., that described in Schiller et al supra; Schiller et al, "Deposition by Electron Beam Evaporation with Rates of up to 50 μm/s," 3rd Conference on Metallurgical Coatings, Apr. 3-7, 1978, San Francisco, Calif.; Thin Solid Films, Vol. 54 (1978) 1.S,9-21, or U.S. Pat. Nos. 3,450,824; 3,409,729; 3,235,647; and 3,234,606; all of whose disclosures are incorporated by reference herein. In such systems, initially the beam is made to propagate parallel to the surface or even upward until it reaches the area immediately above the surface. There, magnetic field lines are provided to bend the beam downward onto the surface of the metal at an appropriately high angle of incidence, e.g., 35°-45° or more so that essentially all of the electrons striking the surface are absorbed, i.e., there being essentially no significant reflection of electrons from the surface due to glancing angles.

Pretreatment of Metal to be Refined by Electron Beam Distillation

In another aspect of this invention, it has been discovered that certain pretreatments carried out under certain conditions will achieve significant advantages when the metal is subsequently refined by electron beam irradiation. In general, it will be more economical to carry out these pretreatment melt steps in conventional furnaces located outside of the vacuum electron beam furnace.

In one pretreatment, the oxygen level of the initial metal melt will be lowered to less than 200 ppm. At higher oxygen contents, it has been discovered that excess spitting and sparking of the metal occur under the action of the electron beam. In addition, if a graphite hearth is used, the melted metal in the hearth will boil violently with splashing when the electron beam is turned on due to the evolution of carbon oxides which form by reaction of the oxygen contained in the melt with the graphite. Similar effects will be observed whenever a melt containing high amounts of oxygen is treated by electron beam in a crucible which can react with oxygen or other components of the melt for that matter to form volatile products. All of these effects are harmful in electron beam operation since they make possible an interaction between the electron beam and gaseous species similar to that mentioned above in conjunction with the magnetic deflection operation. In fact, the effect of volatilization products of oxygen with the crucible can be so severe that the pressure level in the electron beam furnace can increase to an extent that power to the gun is cut off. Despite these now apparent facts, heretofore, the advantages of lowering oxygen levels to less than 200 ppm prior to electron beam irradiation, have not been recognized. In fact in U.S. Pat. No. 3,343,828, it is suggested that a graphite hearth be utilized in conjunction with copper in order to use the reaction of oxygen and carbon to remove oxygen from the copper metal. (See, column 6, lines 42–66.) This is contrary to the pretreatment feature of this invention.

The oxygen content of the melt can be reduced in many ways prior to electron beam irradiation. For example, the metal can be transferred to a conventional furnace and maintained in a melted state, preferably under an inert gas such as nitrogen or argon in a totally enclosed furnace chamber, in the presence of a reductant, e.g., powdered graphite on its surface. Equivalently, the melt can be held under a reducing gas atmosphere. With mild stirring, e.g., that inherently provided by the inductive forces in an induction furnace, the oxygen content will be reduced to a value below 200 ppm over a period of 10–60 minutes, typically 15–20 minutes for the melt held in contact with graphite. Preferably, the oxygen content will be less than 100 ppm, e.g., 50 ppm or lower.

The crucible used to maintain the melt during this reduction treatment must be substantially iron free, e.g., an iron free refractory material or iron free graphite. The basis of this requirement can be seen by inspection of FIG. 1. At the low oxygen contents achieved during the reduction step, any available iron, e.g., any iron in the crucible will be readily reduced and enter the melt. Typically, it is necessary to use a crucible material or furnace lining having an iron content of less than 30 ppm.

FIG. 1 also demonstrates the effect of the oxygen content of a melt on the ability to reduce the melt's iron content in an oxidation operation. The figure shows that iron can be reduced to low levels, e.g., in a copper melt, by maintaining an oxygen content in the melt of greater than about 300 ppm, preferably significantly greater, e.g., about 2000–3000 ppm or more. The oxygen levels in this figure were determined from measurements on a cast sample of the melt and do not represent the equilibrium values in the melt which would be somewhat lower. Similar effects of oxygen level are observed for other impurity elements which have a higher affinity for oxygen than the base metal, e.g., tin or chromium in the copper system or Fe or Al in the lead system. Other examples will be readily apparent from a comparison of the free energies of formation of impurity metal oxides and base metal oxides.

This effect is a surprising one. Heretofore, the beneficial influence of oxygen on removal of iron from copper metal did not suggest that the results of this invention could be achieved. In Oishi et al, Metallurgical Transactions B, Vol. 14B, March 1983–101, it is shown that an iron level of 320 ppm can be achieved at an oxygen contentration of 190 ppm (using a high iron content slag). As FIG. 1 herein shows, for the pretreatment of this invention, at higher oxygen levels, e.g., above 300 ppm in the melt, unexpectedly better results are achieved, i.e., low iron levels of less than about 20 ppm are observed. These are an order of magnitude lower than could be extrapolated from the results of Oishi et al.

When it is desired to reduce the iron or other impurity content of the metal prior to electron beam distillation, it is preferred to employ two steps, i.e., a first oxidation step using relatively high amounts of oxygen in order to decrease the iron or other impurity content, followed by a second reduction step to decrease the oxygen content to a value less than 200 ppm as described above in a substantially iron- or other impurity-free refractory crucible.

The iron or other impurity removal oxidation can be carried out in a furnace heated with oil or gas but electrical induction heating is preferred. This is essentially a conventional operation except as indicated otherwise herein. Simple contact of the melt with air at normal melt temperatures and with the inherent stirring action provided by inductive forces, will provide an oxygen content of about 2000–3000 ppm in approximately 15 minutes in metals such as copper. These are particularly desirable oxygen levels which will readily oxidize the impurity as required. If the metal naturally has a very high initial oxygen content, e.g., over 2000 or 3000 ppm, it may be desirable to add a reduction agent such as carbon, e.g., in the form of graphite or to introduce hydrocarbon gases as is commonly done in poling operations to take the oxygen content down to the 2000 or 3000 ppm level. Otherwise, there may be significant losses of copper to slag during the iron removal stage. See, e.g., Oishi et al, supra.

When the furnace temperature is lowered after the oxidation, e.g., by turning down the power in an induction furnace, a frozen skin of metal and slag containing iron oxide and other oxide impurities will form on the surface of the metal. This can be skimmed off readily as is conventional. If it is desired to optimize removal of certain impurities such as tin at this stage, additional operations facilitating such purifications can also be effected, e.g., a silicate slag can be added before skimming in order to remove tin. In tests, it has been demonstrated that tin can be reduced from over 12 ppm to about 5 ppm using such methods.

Similarly, when the level of iron impurity in the copper metal is low, e.g., on the order of 100–200 ppm or less it will also be desirable to add a slag cover to aid in the removal of iron oxide. Suitable fluxing agents are fully conventional and include, e.g., calcium silicate, silica/lime mixtures, borax, $B_2O_3$, aluminosilicates, or the commerically available CUPRIT (Foseco), etc. The latter is a mixture of sodium carbonate, calcium fluoride and sodium borate.

In batch operation, a solid or semi-liquid flux is preferably used; in large scale continuous or semi-continuous operations, a fluid flux is normally used. It has been found that a slag treatment time of 10–30 minutes is effective to remove substantially all of the iron oxide. Thereafter, in batch operation, the slag can be spooned off the surface and the remaining metal can be cast. In continuous or larger scale operations, the metal can be continuously poured out from under the more viscous immiscible slag layer, leaving the latter behind. This preferred aspect of the pretreatment step of this invention is essentially conventional, e.g., as normally performed in copper smelting.

During the slag treatment, the temperature of the melt is relatively low, e.g., 1100°-1200° C. and the slag thickness will generally have values of up to a few inches; however, for the relatively low iron levels normally encountered in hydrometallurgically processed copper metal, the slag layer will be relatively thin, e.g., up to about 0.5 inch.

Final impurity levels will usually be less than about 100 ppm, preferably less than 50 ppm, 20 ppm or, especially 1-5 ppm or even lower.

Pretreatment operations such as the described iron, tin or other impurity oxide removal will be especially recommended in cases where such impurities are less volatile than the main metallic constituent and the electron beam distillation is operated in a mode wherein the melt is the product to be recovered. This is the case in the silver/copper system of this invention.

Multistage, Horizontal Electron Beam Distillation with Recycle

In an advantageous aspect of this invention, the refinement of copper metal as described above and/or the employment of the iron-removal and/or oxygen-removal pretreatment steps in conjunction with any electron beam distillation of any metal, are carried out in a multistage, essentially horizontal electron beam distillation process with recycle of distillates or residual melt phases. In essence, such a process constitutes a new fractional distillation of metals. However, the realization of a multistage, horizontal electron beam distillation is not really comparable to the conventional fractional distillation of normal liquids such as hydrocarbons. For example, the effect of intermetallic interactions between impurities and/or between an impurity and the bulk metal or the effect on impurity activity of temperature and/or concentration has no precise counterpart in normal fractional distillations. For example, although the results are often the same, as those observed for an azeotrope, i.e., an inability to further purify the bulk material, the underlying basis is entirely different. For azeotropes, equivalence in composition of vapor and liquid is involved; for metals, bonding of one sort or another is often involved. Furthermore, because of the presence of electron beams, there are certain nonobvious but critical requirements which must be observed in the multistage, horizontal distillation with recycle of this invention. These also have no counterpart in normal fractional distillations and are nonobvious even from conventional electron beam operations. Moreover, the multistage, horizontal method of this invention is significantly different from prior art vertical distillations of metals at least because no reflux is involved here.

In each stage of the multistage distillation of this invention, the vaporization rate of the melt must correspond to a total vapor pressure above the surface of the melt of about 0.5 to 7 torr, preferably 1-5 torr as discussed above. Moreover, the electron beam furnace must be evacuated to a pressure of about $10^{-3}$ torr or, preferably, lower, e.g., $10^{-4}-10^{-5}$ torr. For related reasons, it is also necessary that the vapor pressure of the condensate at its condensation temperature be less than about $10^{-3}$ torr. Otherwise, the vapor emanating from the melt, upon condensation on the walls or in the condensers having access to the vacuum chamber, will cause an unacceptably high backflow of gaseous species into the chamber, again causing an unacceptable interaction with the electron beam. At a vapor pressure of $10^{-3}$ torr, approximately 97% or more of the condensate will remain in the liquid phase and will not bounce back into the furnace chamber upon condensation. Exemplary vapor pressures at the melting point include those of copper ($10^{-3}$ torr), and aluminum ($10^{-7}$ torr)

Figure 2:
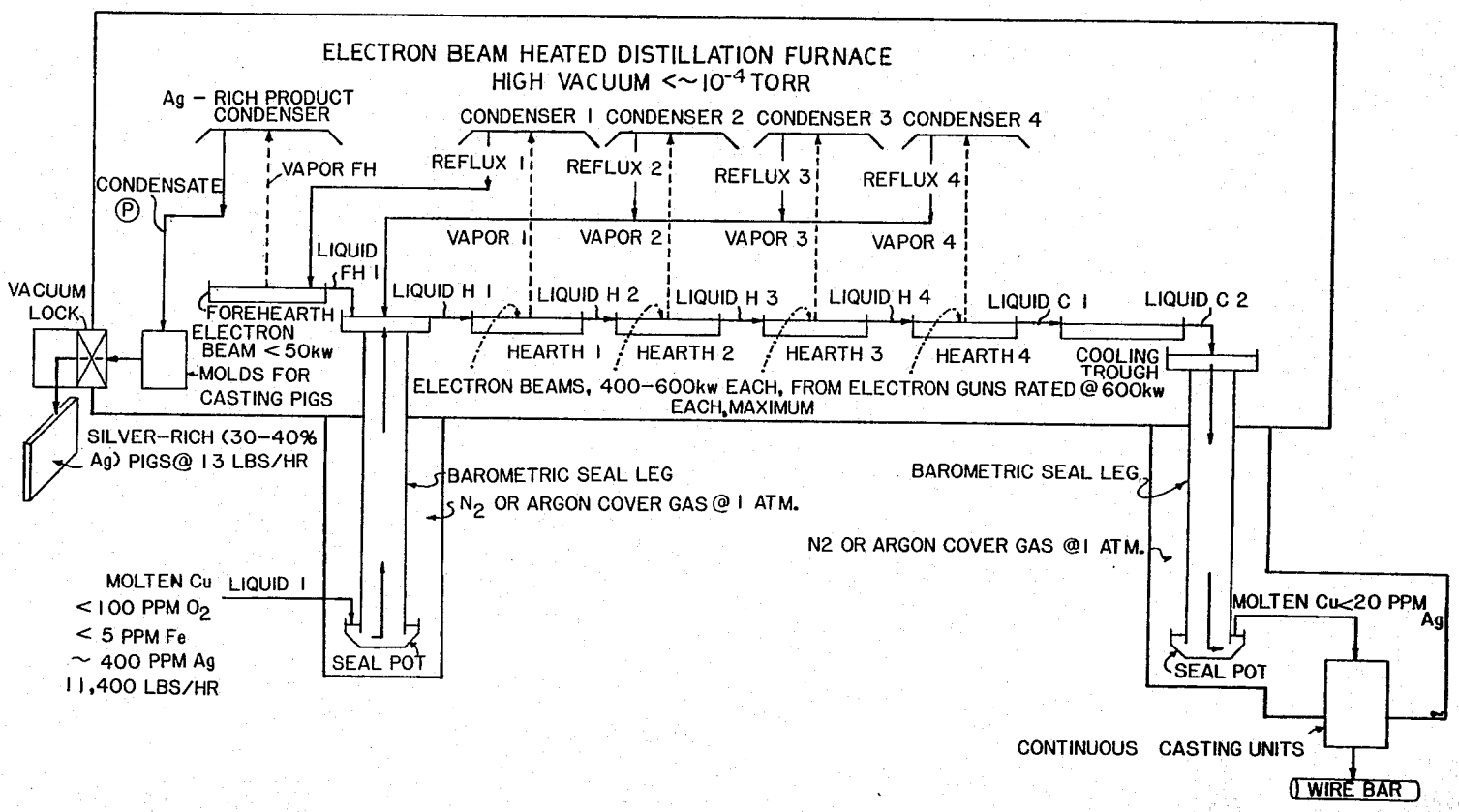
FIG. 2 shows one embodiment of a multistage, horizontal electron beam distillation of this invention with recycle condensates.

This requirement of a maximum vapor pressure of $10^{-3}$ torr for the condensate at its condensation point can be relaxed to some degree where it is economically or otherwise desirable or necessary to operate at somewhat higher vapor pressures, e.g., up to about $10^2$ torr. For example, in the copper/silver system, it may be desired to refine the silver condensate by electron beam distillation thereof to increase its silver content. One example of such a step is shown in FIG. 2 below where a forehearth is used to increase the silver content to values in the range of 30-40%. This forehearth distillation is carried out at relatively low beam power, e.g., less than 50 kw. Under these conditions, the volume of condensate will be relatively low. Thus, the temperature of the condenser can be dramatically lowered to a value lower than the melting point of the condensate, e.g., even to room temperature. The vapor will be collected as a solid of relatively low volume. Hence, for a condenser of large surface area, the operation need be interrupted only occasionally to clean off and recover the solidified distillate. The effects of the increased interaction between the electron beam and the vapor derived from the bounce-back phenomenon can also be minimized by increasing hearth surface area. This will correspondingly increase the vaporization rate.

In the normal electron beam distillation of copper metal containing silver impurities, the amount of silver is so low that it does not raise the vapor pressure of the condensate above the $10^{-3}$ torr level at the condensation point. In general, for the copper/silver system, a content of silver in the condensate of up to about 10% can readily be accommodated without violating the critical vapor pressure level of about $10^{-3}$ torr.

It is another essential feature of the multistage distillation of this invention that at least part of the feeds for all stages will be derived from other stages. In general, the liquid melt phase of each stage will be passed downstream to the succeeding stage to form at least part of the feed for the latter. In addition, the vapor phase from at least one downstream stage will be recycled upstream to a preceding stage to form at least part of the feed thereto. The downstream passing and upstream recycling of the phases from one stage to another enable the achievement, without classical reflux, of a plate-like effect similar to that of fractional distillation as well as a significant materials handling advantage. That is, on a pilot or industrial scale, the sheer bulk of the condensed vapor phases and/or of the refined melt streams would pose insurmountable handling difficulties if only a single stage were employed. Using several stages, materials handling is not a problem.

In a most preferred aspect of this invention, there will be only one vapor phase and only one liquid melt phase which are recovered from the multistage process, i.e., the liquid phase of all stages except the last will be passed downstream as at least part of the feed of the next stage and the vapor phase from all stages except for the first will be recycled back to a preceding stage. The liquid phase of the last stage and the vapor phase of the first stage will normally be the recovered phases. In this way, overall system efficiency is increased both with regard to unit cost per pound of metal of maximum purity and with regard to amterials handling.

Whenever a vapor phase is passed between stages, forward or recycled, it will be condensed in the stage from which it originates and then fed via suitable transport means wherein it will remain liquid throughout its passage from the initiating stage to the receiving stage. This is another critical feature of this invention which differentiates it from the rare prior art horizontal metal distillations which employ multistage techniques. If the vapor phase is not condensed in a manner ensuring that it remains substantially entirely in the condensed phase, once again, unacceptable interaction between vapor and electron beam will occur in one or both of the originating and receiving stages. Any transport means can be employed in this regard as long as it ensures that the vapor phase remains condensed therein but does not cool to an extent that it becomes a solid and hence ceases to flow. One such transport means simply comprises a heated trough or other conduit, e.g., a launder, conventionally maintained at a temperature above the melting point of the condensate but below temperatures which may lead to evaporation. Of course, the surface in contact with the condensate, i.e., the liquid metal, must be compatible therewith; often a refractory oxide or graphite will be used. Other inert metals such as Mo or W can also be used. However, in conjunction with a copper melt, it has been noted that a molybdenum surface will slowly dissolve at high flow rates of molten copper due to its small solubility in Cu. For a stagnant copper melt or at low flow rates, Mo is satisfactory.

Many other equivalent and conventional transport means will be readily recognized by those skilled in the art.

The details of the recycling, the point of entry of the initital feed, and all other relevant parameters, can be routinely determined in conjunction with normal considerations analogous to those of the fractional distillation of customary liquids. For example, it is usually preferred that a recycled condensate will be fed upstream to the preceding stage having a feed which most closely matches the composition of the condensate.

As in all conventional enriching/stripping operations, the stage to which the metal is initially input will be determined primarily by its composition, the degree of purification desired, whether only the primary metallic constituent is to be recovered or whether both the primary metallic constituent and one or more of the impurities are to be recovered, etc. Thus, when it is desired to remove a disposable volatile impurity from a base metal, the input point will be the first stage in the series of stages. The feed of the successive stages will be the melt phase remaining from the previous stage. These feeds become increasingly purer with respect to the volatile impurity due to the successive reboilings. When it is desired to remove a disposable impurity which is less volatile than the base constituent, i.e., to enrich the base metal, the input point will be the last stage downstream. In this configuration, the condensate from each downstream stage becomes the feed for an upstream stage, usually the adjacent stage. Here, it is the volatilized phase of each stage which is repeatedly reboiled (after condensation) and further purified. In the stripping case, the melt phase of the last downstream stage is the recovered product; in the enrichment version, the condensed phase from the first upstream stage is the recovered product.

Intermediate configurations are not only possible but also will be preferred in many instances. For example, when purifying copper containing a valuable impurity such as silver, the metal will be input into one of the first few upstream stages after the first stage. Since silver is more volatile than copper, the purified copper will be recovered as the melt phase from the last downstream stage as discussed. The silver enriched condensate from the input stage, however, will be recycled to the first of the preceding upstream stages. Hence, this silver laden condensate will be further concentrated in silver by reboiling in the upstream stages. A concentrated silver product will be recovered from the vapor phase of the first upstream stage. Analogously, if the metal to be refined contains a valuable impurity which is less volatile than the base metal, the input stage will generally be one of the last few downstream stages before the last stage.

The mentioned silver/copper distillation is illustrated in FIG. 2. While four stages would otherwise be sufficient for purposes of providing a sufficiently refined base metal (copper), an additional forestage is employed to further refine the impurity-enriched phase, in this case, the condensed vapor phase containing silver. The unrefined starting material copper metal is not fed into the first stage per se, but rather is fed into an appropriate point in the overall sequence of stages corresponding as mentioned to the conventional stripping/enriching columns used with normal liquids. To increase efficiency, the phase enriched in the base constituent from the additional forestage is passed forward as part of the feed into the next successive stage which, in essence, is the first base metal purification stage.

Many other configurations are possible and will be readily determinable by those skilled in the art in conjunction with the requirements for any given system. Moreover, all of the considerations relating to electron beam irradiation per se as described above will apply to the inventive horizontal, multistage distillation with recycle method of this invention. These include considerations of beam power, melt temperature, irradiation time, scanning mode, system pressures, gun types, beam propagation methods (e.g., magnetic deflection techniques), crucible dimensions, furnace systems, etc.

By the several methods of this invention, especially in combination with one another, there are obtained exceptionally highly pure metals, especially copper, with excellent properties of conductivity, hardness, ductility, annealability etc. Moreover, this invention achieves these results at relatively low cost and high efficiency.

The foregoing has been described with particular regard to the refinement of copper but the pretreatment aspects and the multistage, horizontal electron beam distillation with recycle aspect are fully applicable to a very wide range of metal/impurity refinement combinations, e.g., Pb/Zn, Mg/Al, Au/Ag—other possibilities will be apparent from tabulated vapor pressure data with the above discussed reservations relating to unpredictable activity effects, e.g., due to intermetallic interactions.

Without further elaboration, it is believed that one skilled in the art can, using the preceding description utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLE 1

CLEAR copper crystals were melted in air in a gas fired furnace. The melt was sampled and found to have the composition I of Table 1. After a 15 minute period of oxidation (i.e., by maintaining the melt at an oxygen level of 1000 ppm), a coagulant was added and the surface slag was skimmed off to remove iron and the melt was found to have the composition II. Reduction of the melt reduced the oxygen content from 473 ppm to 204 ppm by covering it with a 1 inch layer of graphite for about 15 minutes. This metal was poured into molds giving buttons weighing 300–500 g. These buttons were placed in a graphite crucible in a small 5 kw electron beam furnace operating at a vacuum of 0.1 $\mu$m Hg($10^{-4}$ torr). The buttons were first melted under low EB power (about 1.5 kw). The power was then increased (about 4.7 kw) to give the characteristic green plasma indicative of metal vaporization. The analysis of the metal remaining after 18% weight loss (i.e., 18% of the metal had been vaporized) is shown in III below. The results demonstrate the marked reduction in the content of volatile impurities, Ag, Pb, Bi, S, and $O_2$ despite the relatively high original levels thereof. The metal was subjected to standard ASTM tests and found to have a high conductivity of 101.2 IACS and a Rockwell hardness of 35, indicating good annealability characteristics for wire drawing.

EXAMPLE 2

Approximately 400 lbs. of CLEAR crystals were melted in an induction furnace (Inductotherm VIP, Powertrak 200-10) having a maximum power rating of about 150 kw. For the initial iron removal step, a clay graphite crucible was used. By the method of air oxidation followed by surface skimming, the iron content was reduced from about 30 ppm to about 12 ppm. The metal was cast into 50 lb. pigs.

TABLE 1

IMPURITIES IN COPPER AFTER VARIOUS STAGES OF REFINING
(All concentrations in parts per million, ppm)

| Stage | Se | Ti | Bi | Sb | As | Pb | S | Sn | Ni | Fe | Ag | O |
|---|---|---|---|---|---|---|---|---|---|---|---|---|
| I | <2 | <2 | ~4 | 5 | 7 | ~58 | 35 | 22 | 4 | >35 | ~240 | |
| II | <2 | <2 | ~4 | 2 | 7 | ~58 | 28 | 22 | 4 | 26 | ~240 | 473 |
| III | <2 | <2 | 0.1 | 5 | 5 | <1 | <2 | 3 | 5 | 6 | <1 | 13 |

These were later remelted in an iron-free graphite crucible large enough to hold the 400 lb. sample and installed in the same induction furnace. When the metal had melted, the surface was covered with a 1 inch layer of powdered graphite for a period of approximately 15 minutes. The metal was cast into 50 lb. pigs, care being taken to prevent oxidation by covering the melt surface in the molds with powdered graphite. It was found that the oxygen content had been reduced to about 200 ppm $O_2$.

Figures 2, 3:
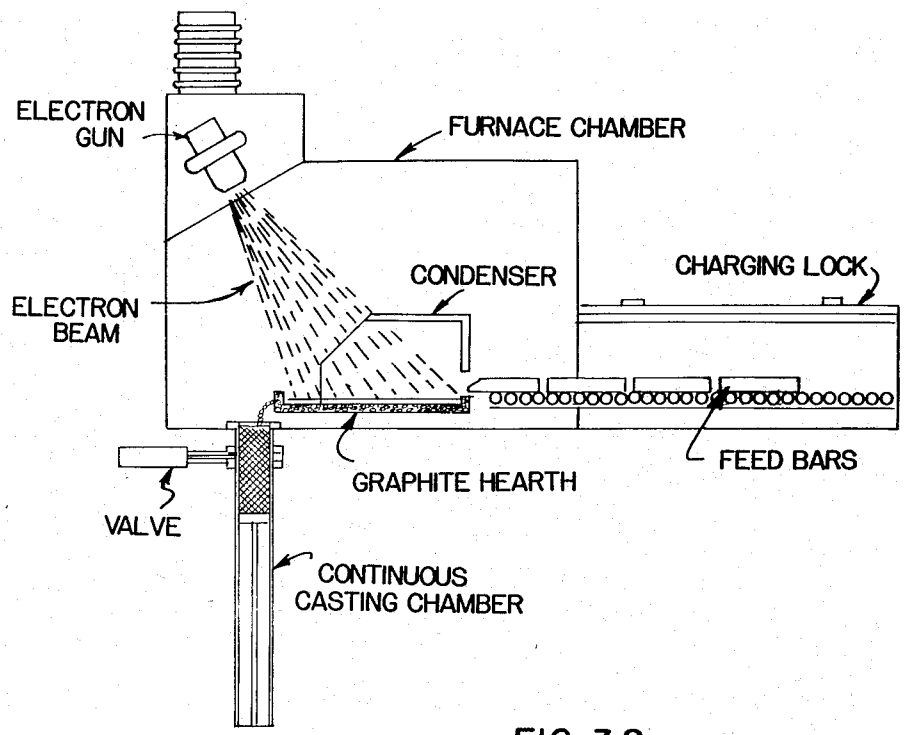
FIG. 3 shows one configuration of a single stage electron beam furnace.
Figures 1, 3:
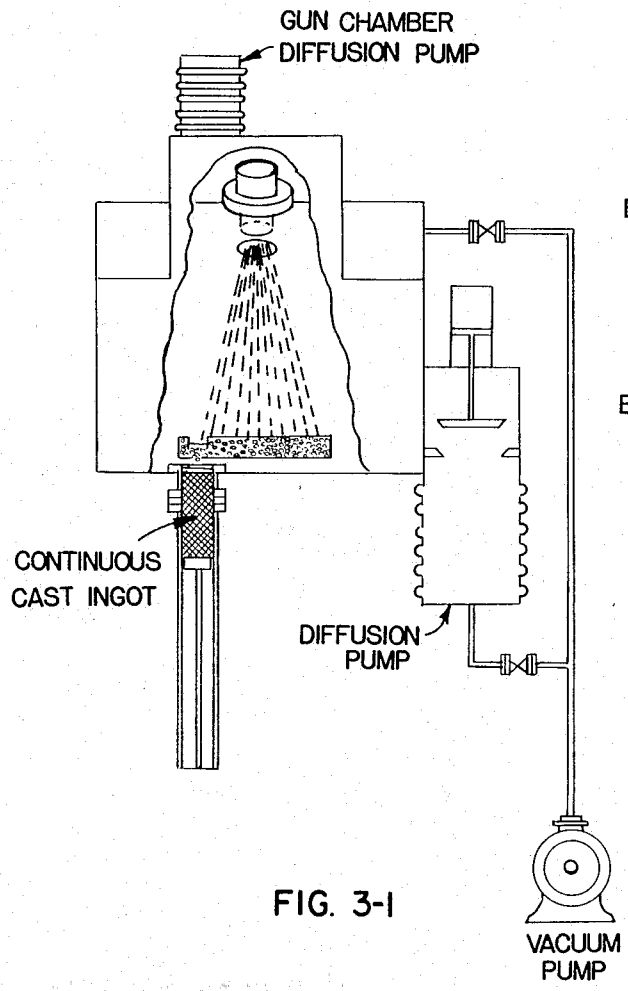

Pigs of the low iron, low oxygen containing metal were then fed to a 250 kw electron beam furnace (FIG. 3) maintained at a vacuum of approximately $10^{-4}$ torr. The original composition of the metal is given in the first row of Table 4. Five passes were made. The first pass was a degassing run. The EB power was only maintained at a level sufficient to melt the copper onto a 10 inch×23 inch×1 inch depth graphite hearth. The metal was then continuously cast into a 3 inch diameter ingot. The recovered ingot had a weight of 232 lbs and its analysis is given in Table 2. The metal was then passed through the furnace three times in 3 evaporation runs at a power rating of about 90 kw. Attempts were made to evaporate about 10% of the metal in each pass but this was difficult to control with small 200 lb. batches. Thereafter, a final casting run was made wherein the EB power was only sufficient to melt the metal and allow it to pass across the hearth into the casting chamber. During the evaporation runs, the evaporated metal was condensed onto a radiantly cooled graphite plate held about 1 ft. above the hearth surface. The analyses of the metal after the degassing run, the 3 evaporation runs and the final ingot casting run are given in Table 2. The results show that elements such as Bi, Pb, Te, and Se are rapidly distilled out of the copper in the EB furnace despite the relatively high starting amounts of impurities. After only the first evaporation run, the concentrations of these elements are reduced to very low levels.

TABLE 2

REFINING OF COPPER IN AN ELECTRON BEAM FURNACE
(All concentration is ppm)

| Stage | Se | Te | Bi | Sb | As | Pb | S | Sn | Ni | Fe | Ag | Zn | O |
|---|---|---|---|---|---|---|---|---|---|---|---|---|---|
| DEGAS RUN | 0.1 | 2.0 | 1.5 | 4 | 5 | 13 | 6 | 12 | 10 | 11 | 450 | 3.5 | 39 |
| 1st EVAP RUN | <0.1 | 0.5 | <0.1 | 4 | 4 | 0.4 | 10 | 12 | 11 | 12 | 161 | 2.2 | 47 |
| 2nd EVAP RUN | <0.1 | <0.1 | <0.1 | 3 | 5 | <0.1 | 9 | 12 | 11 | 14 | 48 | — | — |
| 3rd EVAP RUN | <0.1 | <0.1 | <0.1 | 4 | 5 | <0.1 | 6 | 11 | — | 15 | 13 | 0.5 | 45 |
| FINAL CAST INGOT | <0.1 | <0.1 | <0.1 | 3 | 5 | <0.1 | — | 12 | 10 | 14 | 16 | <0.1 | — |

In the case of silver, the concentration was reduced from 450 ppm to 161, 48 and 13 ppm after the 1st, 2nd and 3rd evaporation stages respectively. As a rough approximation, in the low silver range characteristic of industrial operation, it has been found that the silver content is reduced by half for every 2% volatilization of copper. This volatility relationship can also be derived from the work of Santala et al supra at much higher silver levels. It was unexpected that changes in activity and/or intermetallic interactions did not change this relationship. Thus, for an initial silver concentration of X and a final concentration of Y, the number of 2% volatilizations z is governed by the approximate relationship:

$$X/2^z = Y.$$

Hence, the approximate percentage of base copper metal which must be volatilized can be calculated as:

$$6.6 \log(X/Y) \text{ wt } \%.$$

More generally, the total weight percentage to be volatilized will be in the range defined by $$a \log (X/Y) \text{ wt } \%$$

wherein a is 5–20.

The final ingot produced in the run described above was drawn to a ⅝th inch bar and submitted for tensile testing according to ASTM spec E-8. In the results given in Table 3 below, the data for the EB refined copper are compared with those for a commercially produced rod for wire drawing.

TABLE 3

SUMMARY OF TENSILE TEST RESULTS

Test Sample: length 1 in, diameter 0.25 in
Strain Rate: 0.1 in/min

| Specimen | | UTS (psi) | YS 0.2% OS (psi) | % Elong. in 1 in. | % Red. in Area |
|---|---|---|---|---|---|
| Wire Rod | A | 32,900 | — | 50 | 68 |
| | B | 32,575 | 14,400 | 50 | 72 |
| EB Refined | A | 32,790 | 16,560 | 50 | 94 |
| | B | 32,590 | 16,500 | 53 | 94 |

A and B designate one of two duplicate samples which were analyzed.

The results for the EB refined metal compare favorably with those reported for high grade OFHC copper which are: UTS—32,000 psi, Elongation—50 (max) and % Reduction in Area=94/95. Furthermore, these excellent results are achieved at very low cost.

EXAMPLE 3

Table 4 summarizes the process of this invention for the production of high purity copper of controlled oxygen content, such as is required for magnet wire or other specialized applications. These data are based on a host of examples. The analysis of the starting material crystals of electrolytically produced CLEAR copper is given in the first row. Melting in air will result in the loss of any occluded chloride and a reduction in sulfur content. The level of oxygen removal will depend on the type of crucible used. The figure given in Table 4 is typical for metal melted in clay-graphite or silicon-carbide crucibles. During the iron removal stage, there will be a further reduction in sulfur content along with iron and tin if a silicate slag is used. During the oxygen removal step, the melt is maintained in a reducing environment and, usually, the only change in composition will be in the oxygen content.

TABLE 4

STAGEWISE IMPURITY REMOVAL FROM CLEAR COPPER

| SAMPLE NO. | GROUP 1 SE | GROUP 1 TE | GROUP 1 BI | GROUP 2 SB | GROUP 2 AS | GROUP 2 PB | GROUP 3 S | GROUP 4 SN | GROUP 4 NI | GROUP 4 FE | GROUP 5 AG | OXYGEN |
|---|---|---|---|---|---|---|---|---|---|---|---|---|
| CLEAR CRYSTALS | <1 | <5 | 8 | 1–6 | 5 | >10 | 170 | <2 | <2 | >50 | >300 | 5000 |
| ↓ | | | | | | | | | | | | |
| MELT | <1 | <5 | 8 | 1–6 | 5 | >10 | 40 | <2 | <2 | >50 | >300 | 2000 |
| ↓ | | | | | | | | | | | | |
| REMOVE IRON | <1 | <5 | 8 | 1–6 | 5 | >10 | 20 | <2 | <2 | 5 | >300 | 2000 |
| ↓ | | | | | | | | | | | | |
| REMOVE OXYGEN | <1 | <5 | 8 | 1–6 | 5 | >10 | 20 | <2 | <2 | 5 | >300 | 100 |
| ↓ | | | | | | | | | | | | |
| EB REFINE | <1 | <2 | <0.1 | 1–6 | 5 | >10 | 9 | <2 | <2 | 6 | 15 | 30 |
| Proposed Spec | | | | | | | | | | | | |
| ASTM | | 5 | | | 18 | | 25 | | 15 | | 25 | |
| LME | | 3 | | | 15 | | 15 | | 20 | | 25 | |

*ALL VALUES IN PPM
═══ indicates removal of an impurity in a step

Finally, the elements removed by volatilization in the multistage EB refining step of this invention will include Se, Te, Bi, Pb, Zn, S, O and Ag. It can be seen that the final concentrations of impurities in the copper when refined by this invention will be below the specifications proposed by the ASTM and the LME.

EXAMPLE 4

A multihearth, horizontal distillation, with recycle, of CLEAR copper is carried out. As in many other cases, the process has special relevance to silver which will often be the major impurity to be removed from the copper. The silver contents of the various process streams shown in FIG. 2, are given in the material balance description of Table 5.

Referring to FIG. 2, the copper feedstock flows vertically upward in the conventional barometric seal leg into the vacuum vessel. Other conventional methods for introducing the melt into the furnace can also be used, e.g., the metal may be introduced into the furnace as a solid via a vacuum lock. However, for the latter technique, additional energy will be required to melt the metal using conventional methods such as resistance heating or using the electron beam itself.

The feedstock then mixes with other flows of molten copper within the distillation furnace (as described below), and flows into the first of four graphite hearths in tandem. The details of the hearths, furnace, guns, etc. are as described previously herein. The silver concentration in this mixed feed is 1600 ppm. These hearths are each heated with 400 to 600 kw of electron beam power, using a separate gun rated at 600 kw maximum EB power for each hearth. In each case the beam is focussed onto the hearth by magnetic beam deflection so that the region of interaction between the beam and the vapor escaping from the surface is less than about 1 foot in the largest dimension.

TABLE 5

MATERIAL BALANCE FOR SILVER RECOVERY BY E/B DISTILLATION

Throughput:
125 MT of CLEAR Copper/Day ("Instantaneous")
105 MT of CLEAR Copper/Day ("Average")
Feed Composition:
CLEAR copper, containing 400 ppm of silver
Product:
Copper cast as wire bar or rod, containing <20 ppm of Ag, 5-30 ppm of oxygen, <5 ppm of Fe, and within specifications (ASTM and LME) for all other elements.
PROCESS FLOWS AND COMPOSITION*

| DESIGNATION | TEMP. °C. | FLOW RATE | COMPOSITION |
|---|---|---|---|
| Liquid 1 | 1150 | 11,400 | Fe: <5 ppm; Ag: 400 ppm; Se, Te, Pb, Bi, S: >35 ppm |
| Liquid H1 | 1150 | 13,200 | Ag: 1600 ppm |
| Condensate 1 | 1150 | 133 | Ag: ~4% |
| Condensate P | 1150 | 13 | Ag: ~39% |
| Liquid FH1 | ~1300 | 120 | Ag: 1200 ppm |
| Liquid H2 | ~1700 | 13,060 | Ag: 1200 ppm |
| Condensate 2 | 1150 | 530 | Ag: 2.3% |
| Liquid H3 | ~1700 | 12,530 | Ag: 280 ppm |
| Condensate 3 | 1150 | 530 | Ag: 0.54% |
| Liquid H4 | ~1700 | 12,000 | Ag: ~60 ppm |
| Condensate 4 | 1150 | 530 | Ag: 0.12% |
| Liquid C1 | ~1700 | 11,387 | Ag: <20 ppm |
| Liquid C2 | ~1150 | 11,387 | Ag: <20 ppm |

*based on the observed 50% reduction in silver concentration for a 2% volatilization of copper metal.

The movement of the beam is programmed to traverse the surface area of the metal in the hearth in a pre-set manner to provide the listed temperatures for impurity distillation. Residence times are about 3-5 minutes in each hearth. In this way the molten copper is heated to instantaneous temperatures of about 1600°-1700° C., to evaporate about 1% of the copper flowing along the first hearth. The vapor pressure at the surface of the melt at the downstream end of this hearth and under these conditions is about 3 torr. The total pressure in the furnace is about $1\times10^{-4}$ torr.

The copper vapor flowing upward from this first hearth is condensed and is recycled as a liquid flowing upstream as a feed to the forehearth. This condensate is maintained at a temperature of about 1150° C., and contains silver at a concentration of about 4%. Because the initial silver content is sufficiently high and because of the worth of silver in the marketplace, inclusion of the forehearth is advantageous. When recovery and further concentration of the volatilized impurities is not economically or otherwise justifiable, condensate 1 will normally simply be removed from the process flow.

The condensate fed to the forehearth is heated with less than 50 kw of electron beam power in order to evaporate about 10% of the metal flowing across the hearth and yet maintain effective electron beam operation. If necessary, a cold condenser is used and the condensate is solidified to lower the vapor pressure of the condensate. Approximately 97% of the silver is evaporated and condensed as molten silver-copper alloy containing approximately 35 to 40% of silver. This silver-rich liquid is fed via heated troughs that direct the metal into molds in which it is solidified. This metal can be removed batchwise from the distillation furnace for subsequent silver recovery by conventional processes e.g., electro-refining. Alternatively, the temperature of the condenser is lowered to a temperature between room temperature and the condensation temperature in order to collect the silver-laden vapor as a solid and minimize vapor bounce back. Preferably, the molten copper flowing from the forehearth is returned to the feed stock in the distillation furnace. The silver content of this returning stream is about 1200 ppm.

The molten copper from the first main hearth flows across the next three hearths in tandem. From each, about 4% of the copper-silver is evaporated. The corresponding vapor streams remove sufficient silver from the melts that the copper product flowing from the fourth hearth is within specification for silver content, namely less than about 20 ppm and much lower if desired, e.g., by increasing residence time or beam power.

The transfer of the copper melt from hearth to hearth is effected fully conventionally, e.g., using hearths similar to those described in Schiller et al, supra, or even using one continuous hearth, e.g., the serpentine hearth of U.S. Pat. No. 3,343,828, whose disclosure is incorporated by reference herein, wherein the separate hearths of this invention correspond to separate zones along the continuous path.

The vapor from each of the three subsequent hearths is condensed, preferably separately in each stage, and maintained as a liquid at about 1150° C. during recycle. Preferably, the three condensates are mixed together (in this particular choice of operating parameters) and then mixed with the primary feed stock stream in the distillation furnace as shown. The net composition of this mixture of feed streams to the first main hearth is 1600 ppm of silver.

The molten copper from the fourth hearth has a temperature of about 1700° C. and is cooled by flowing along a radiantly cooled trough. At a temperature of about 1150° C., it flows into the top end of a conventional barometric seal leg, the bottom end of which is immersed in a seal pot outside the vacuum vessel of the distillation furnace. The molten metal flows down the seal leg, into the seal pot, and overflows into a holding furnace from which it is fed into a conventional continuous casting apparatus configured for wire bars or wire rod. This molten metal is protected from oxidation by means of a cover gas of nitrogen or argon.

EXAMPLE 5

The process of example 4 is repeated except that the pretreatments described in example 1 are carried out prior to introduction of the copper into the input barometric seal leg.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method of refining copper metal which contains at least 35 ppm in total of selenium, tellurium, sulfur, bismuth and lead impurities and at least 20 ppm of silver impurity, which impurities are capable of forming intermetallic species with copper atoms, with each other or with other impurities in the copper metal, comprising passing the copper metal across a hearth in a vacuum effective to enable electron beam operation and irradiating the metal with an electron beam of sufficient strength and duration to heat the metal and volatilize a portion thereof, whereby, in the remaining copper metal, the total content of selenium, tellurium, sulfur, bismuth and lead is reduced to less than about 20 ppm and the silver content is reduced to less than about 16 ppm.

2. A method of claim 1 wherein the strength and duration of the electron beam are selected to vaporize a weight percentage of the original amount of copper metal which is about $a \cdot \log_{10}(X/Y)$ wt %, wherein X is the silver content of the original copper metal, and Y is the final, reduced silver content after electron beam irradiation and a is 5–20.

3. A method of claim 1 wherein the silver content in the copper metal to be refined is greater than 300 ppm.

4. A method of claim 1 or 3 wherein the reduced silver content after electron beam irradiation is less than 5 ppm.

5. A method of claim 1 or 3 wherein the total content of selenium, tellurium, sulfur, bismuth and lead in the copper metal to be refined is greater than 100 ppm.

6. A method of claim 5 wherein the reduced total content of bismuth, selenium, and tellurium is less than 8 ppm.

7. A method of claim 5 wherein the reduced total content of bismuth, selenium, and tellurium is less than 3 ppm.

8. A method of claim 5 wherein the copper metal to be refined additionally contains about 200 ppm of oxygen and, after electron beam irradiation, the reduced total content of oxygen is less than about 60 ppm.

9. A method of claim 5 wherein the reduced total content of lead is less than about 6 ppm and of sulfur is less than about 20 ppm.

10. A method of claim 1 wherein the copper metal to be refined has been obtained from hydrometallurgical processing.

11. A method of claim 10 wherein the copper metal to be refined is CLEAR copper.

12. A method of claim 1 wherein the electron beam irradiation is effective to raise the temperature of the molten copper metal to 1350°–1800° C.

13. In a method of refining a metal by volatilization of a portion thereof by electron beam irradiation, the improvement wherein the metal contains a nonvolatile impurity which has a higher affinity for oxygen than said metal, and the method further comprises, prior to treating the metal with the electron beam for refinement, melting the metal under conditions whereby its oxygen content is adjusted to a value greater than about 300 ppm, maintaining the melt for a time sufficient for the formation of an oxide of said impurity, and then separating the oxide of said impurity from the melted metal whereby the content of said impurity is lowered to a level less than 100 ppm.

14. A method of claim 13 wherein the surface of the melt is covered with a fluxing agent which forms a surface slag with the impurity oxide;

and further comprising removing the impurity oxide formed during the melting step by separating the slag and the melt.

15. A method of claim 13 wherein the oxygen content during said impurity removal step is adjusted to a value greater than about 2000 ppm.

16. A method of claim 13, 14 or 15 wherein said impurity is iron and the metal being refined is copper.

17. In a method of refining a metal by volatilization of a portion thereof by electron beam irradiation, the improvement wherein when the metal has an oxygen content greater than 200 ppm, and the method further comprises, prior to treating the metal with the electron beam for refinement, melting the metal under conditions whereby its oxygen content is lowered to a value less than 200 ppm.

18. A method of claim 17 wherein said oxygen removal step comprises holding a melt of the metal under a graphite surface layer or a reducing atmosphere for a period of time effective to lower the oxygen content to less than 200 ppm.

19. A method of claim 13, further comprising, after said impurity oxide separation step and prior to treating the metal with the electron beam for refinement, treating a melt of the metal under conditions whereby its oxygen content is lowered to a value less than about 200 ppm.

20. A method of claim 17 or 19 wherein, during the electron beam irradiation, the metal is contained in a crucible which can react with oxygen in the melted metal to form a volatile product.

21. A method of claim 20 wherein the crucible comprises graphite.

22. A method of claim 13, 17 or 19 wherein the metal being refined is copper containing silver as an impurity.

23. A method of claim 1 wherein the copper metal also contains a nonvolatile impurity which has a higher affinity for oxygen than said metal, and the method further comprises, prior to treating the metal with the electron beam for refinement, melting the metal under conditions whereby its oxygen content is adjusted to a value greater than about 300 ppm, maintaining the melt for a time sufficient for the formation of an oxide of said impurity, and then separating the oxide of said impurity from the melted metal.

24. A method of claim 1 wherein the metal has an oxygen content greater than 200 ppm, and the method further comprises, prior to treating the metal with the electron beam for refinement, melting the metal under conditions whereby its oxygen content is lowered to a value less than 200 ppm.

25. A method of claim 23 further comprising, after said impurity oxide separation step and prior to treating the metal with the electron beam for refinement, treating a melt of the metal under conditions whereby its oxygen content is lowered to a value less than about 200 ppm.

26. A method of claim 24 or 25 wherein, during the electron beam irradiation, the metal is contained in a crucible comprising graphite.

27. A multistage method of refining a metal containing at least two metallic components in at least two sequential metal vaporization stages substantially horizontally arranged and each having a metal feed thereto, comprising, in each stage, irradiating the metal feed with an electron beam effective to heat the metal to a temperature at which the total vapor pressure of the melt is about 0.5 to 7 torr, and at which the partial vapor pressure of at least one metal component of the melt is different from that of at least one other metal component of the melt, and forming a vapor phase and a melt phase in which each phase is either enriched or depleted in at least one metal component;

wherein the vapor pressure of the condensate of said vapor phase at its condensation point is less than about $10^{-3}$ torr;

and wherein the effective operating pressure of each stage is maintained at a low level compatible with electron beam irradiation;

passing the melt phase of each stage downstream to form at least part of the feed of the next stage; and recycling the vapor phase of at least one stage upstream to at least one preceding stage to form at least part of the feed thereto;

wherein all vapor phases passing between stages are condensed in the originating stage to form a corresponding liquid phase which is fed to the receiving stage via a transport means in which said phase remains liquid throughout its passage in and between stages; and wherein the metal to be refined contains a nonvolatile impurity which has a higher affinity for oxygen than said metal, and the method further comprises, prior to treating the metal with the electron beam for refinement, melting the metal under conditions whereby its oxygen content is adjusted to a value greater than about 300 ppm, maintaining the melt for a time sufficient for the formation of an oxide of said impurity, and then separating the oxide of said impurity from the melted metal.

28. A multistage method of refining a metal containing at least two metallic components in at least two sequential metal vaporization stages substantially horizontally arranged and each having a metal feed thereto, comprising, in each stage, irradiating the metal feed with an electron beam effective to heat the metal to a temperature at which the total vapor pressure of the melt is about 0.5 to 7 torr, and at which the partial vapor pressure of at least one metal component of the melt is different from that of at least one other metal component of the melt, and forming a vapor phase and a melt phase in which each phase is either enriched or depleted in at least one metal component;

wherein the vapor pressure of the condensate of said vapor phase at its condensation point is less than about $10^{-3}$ torr;

and wherein the effective operating pressure of each stage is maintained at a low level compatible with electron beam irradiation;

passing the melt phase of each stage downstream to form at least part of the feed of the next stage; and recycling the vapor pahse of at least one stage upstream to at least one preceding stage to form at least part of the feed thereto;

wherein all vapor phases passing between stages are condensed in the originating stage to form a corresponding liquid phase which is fed to the receiving stage via transport means in which said phase remains liquid throughout its passage in and between stages; and wherein the metal to be refined has an oxygen content greater than 200 ppm, and the method further comprises, prior to treating the metal with the electron beam for refinement, melting the metal under conditions whereby its oxygen content is lowered to a value less than 200 ppm.

29. A method of claim 27 further comprising, after said impurity oxide separation step, and prior to treating the metal with the electron beam for refinement, treating a melt of the metal under conditions whereby its oxygen content is lowered to a value less than about 200 ppm.

30. A multistage method of refining a metal containing at least two metallic components in at least two sequential metal vaporization stages substantially horizontally arranged and each having a metal feed thereto, comprising, in each stage, irradiating the metal feed with an electron beam effective to heat the metal to a temperature at which the total vapor pressure of the melt is about 0.5 to 7 torr, and at which the partial vapor pressure of at least one metal component of the melt is different from that of at least one other metal component of the wherein the vapor pressure of the condensate of said vapor phase at its condensation point is less than about $10^{-3}$ torr;

and wherein the effective operating pressure of each stage is maintained at a low level compatible with electron beam irradiation;

passing the melt phase of each stage downstream to form at least part of the feed of the next stage; and recycling the vapor phase of at least one stage upstream to at least one preceding stage to form at least part of the feed thereto;

wherein all vapor phases passing between stages are condensed in the originating stage to form a corresponding liquid phase which is fed to the receiving stage via transport means in which said phase remains liquid throughout its passage in and between stages; and wherein the metal to be refined is copper metal which contains at least 35 ppm in total of selenium, tellurium, sulfur, bismuth and lead impurities and at least 20 ppm of silver impurity, which impurities are capable of forming intermetallic species with copper atoms, with each other or with other impurities in the copper metal, and wherein, after treatment in said multistage method, the refined copper metal has a total content of selenium, tellurium, sulfur, bismuth and lead of less than about 20 ppm and a silver content of less than about 16 ppm.

31. A method of claim 29 wherein the metal to be refined is copper metal which contains at least 35 ppm in total of selenium, tellurium, sulfur, bismuth and lead impurities and at least 20 ppm of silver impurity, which impurities are capable of forming intermetallic species with copper atoms, with each other or with other impurities in the copper metal, and wherein the refined copper metal after treatment in said multistage method has a total content of selenium, tellurium, sulfur, bismuth and lead of less than about 20 ppm and a silver content of less than about 16 ppm.

* * * * *